US007866295B2

(12) United States Patent
Shi et al.

(10) Patent No.: US 7,866,295 B2
(45) Date of Patent: Jan. 11, 2011

(54) PISTON SKIRT OIL RETENTION FOR AN INTERNAL COMBUSTION ENGINE

(75) Inventors: Fanghui Shi, Rochester Hills, MI (US); Yang T. Cheng, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/867,859

(22) Filed: Oct. 5, 2007

(65) Prior Publication Data

US 2009/0090325 A1 Apr. 9, 2009

(51) Int. Cl.
*F02F 3/00* (2006.01)

(52) U.S. Cl. ..... 123/193.6; 123/193.4; 123/193.2

(58) Field of Classification Search .... 123/193.1–193.6
See application file for complete search history.

(56) References Cited

U.S. PATENT DOCUMENTS 2,980,593 A * 4/1961 Larson ..... 205/131
4,314,531 A * 2/1982 Bruni ..... 123/193.4
7,383,807 B2 * 6/2008 Azevedo et al. ..... 123/193.6
2001/0042801 A1 * 11/2001 Shouji et al. ..... 239/585.1

FOREIGN PATENT DOCUMENTS

JP 406185405 A * 7/1994 ..... 123/193.6
JP 2007046496 A 2/2007

* cited by examiner

*Primary Examiner*—M. McMahon
(74) *Attorney, Agent, or Firm*—Quinn Law Group, PLLC

(57) ABSTRACT

An internal combustion engine is provided having a cylinder case with at least one cylinder bore wall defining at least one cylinder bore. At least one piston is reciprocally movable within the at least one cylinder bore. The at least one piston includes at least one skirt portion preferably having a barrel-shaped profile. The cylinder bore wall has an oleophobic characteristic, while the at least one skirt portion has an oleophilic characteristic. The oleophobic and oleophilic characteristic is produced by at least one of coating and machining the at least one cylinder bore wall and the at least one skirt portion, respectively.

6 Claims, 2 Drawing Sheets

PISTON SKIRT OIL RETENTION FOR AN INTERNAL COMBUSTION ENGINE

TECHNICAL FIELD

The present invention relates to an internal combustion engine having at least one cylinder bore wall defining a cylinder bore within which at least one piston is slidable such that a skirt portion of the at least one piston engages the at least one cylinder bore wall.

BACKGROUND OF THE INVENTION

Oil availability within a gap or interface defined by a piston skirt and cylinder bore wall of an internal combustion engine is desirable for the reduction of noise and frictional losses during engine operation. Near top dead center firing of the piston's expansion or power stroke, where in-cylinder pressures increase the thrust load exerted by a skirt portion of the piston against the cylinder bore wall, an increase in contact may occur between the skirt portion and the cylinder bore wall as a result of oil film penetration. Increasing the quantity of oil within the interface at top dead center may be achieved by multiple methods such as increasing the amount of oil splashed or directed to the interface by the rotating components of the engine, providing oil squirters to direct oil to the interface, and retaining an amount of oil during the up-stroke of the piston, i.e. during the movement of the piston from a bottom dead center position to the top dead center position.

SUMMARY OF THE INVENTION

An internal combustion engine is provided having a cylinder case with at least one cylinder bore wall defining at least one cylinder bore. At least one piston is reciprocally movable within the at least one cylinder bore. The at least one piston includes at least one skirt portion, preferably having a barrel-shaped profile. The cylinder bore wall has an oleophobic characteristic, while the at least one skirt portion has an oleophilic characteristic. Oleophilic refers to the property of having a strong affinity for oil, while oleophobic refers to the property of having a reduced or no affinity for oils. The oleophobic and oleophilic characteristic is produced by at least one of coating and machining the at least one cylinder bore wall and the at least one skirt portion, respectively.

During operation of the internal combustion engine, oil droplets formed on the at least one cylinder bore wall of the cylinder case are unstable as a result of the oleophobic characteristic, i.e. a high contact angle between oil droplets and the cylinder bore wall, causing the oil droplets to either drop from the cylinder bore wall or contact the at least one skirt portion and attach thereto, as a result of the oleophilic characteristic, i.e. a low contact angle between oil droplets and the at least one skirt portion, of the at least one skirt portion. In so doing, the oil is provided to lubricate the piston as it translates within the at least one cylinder bore, while reducing the amount of oil that wets or attaches to the at least one cylinder bore wall of the cylinder case.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
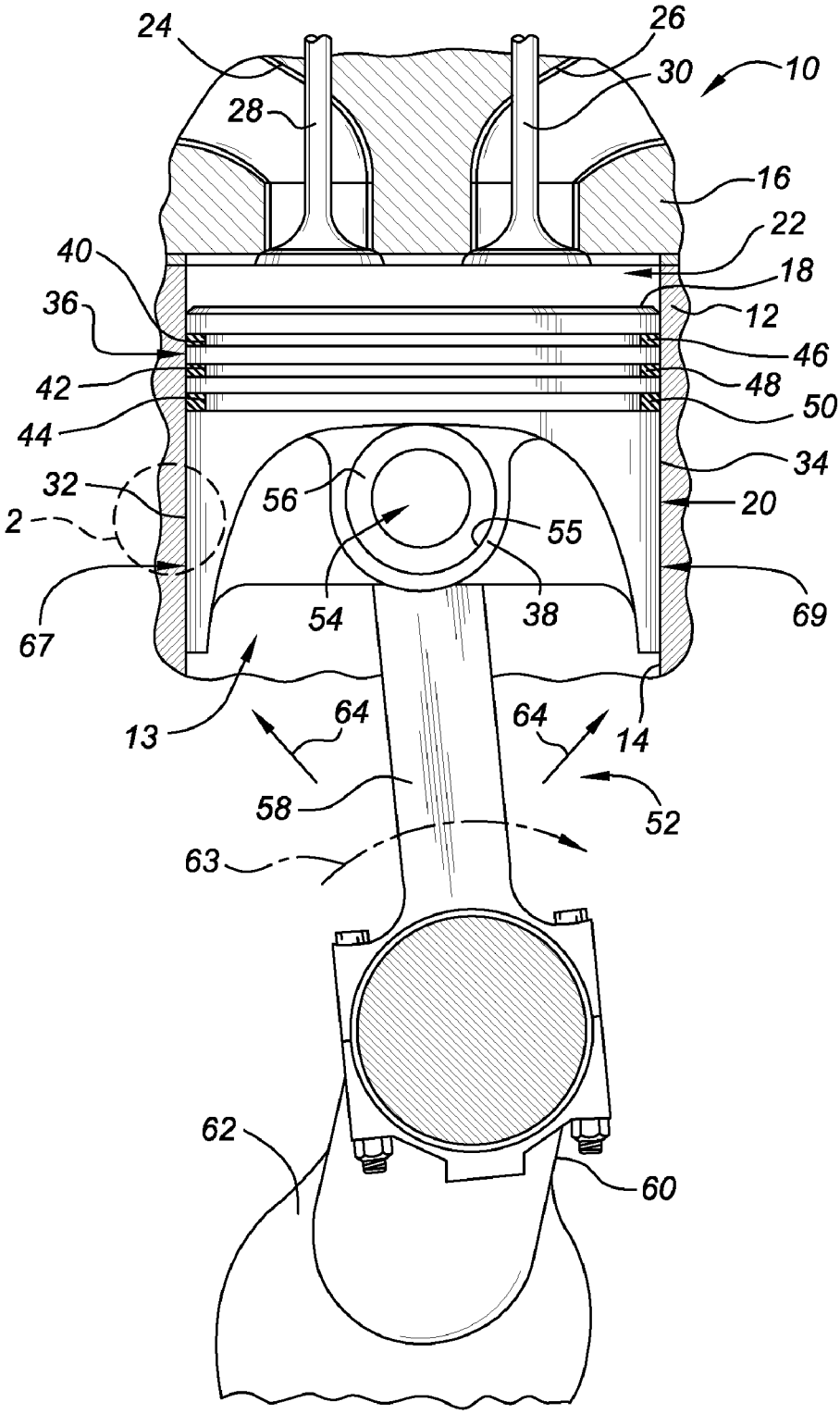
FIG. 1 is a transverse sectional fragmentary view, partly in elevation, of an internal combustion engine illustrating a piston reciprocally movable therein.

Referring to FIG. 1 of the drawings, there is shown a portion of an internal combustion engine generally indicated by the numeral 10. The engine 10 includes a cylinder case 12 defining a plurality of cylinder bores 13 having generally cylindrical walls 14, only one of which is shown and described. Closing one end of the cylinder bore 13 is a cylinder head 16, which cooperates with a crown portion 18 of a piston 20 to define a variable volume combustion chamber 22. The cylinder head 16 defines intake and exhaust ports 24 and 26, respectively, which are selectively opened by respective poppet valves 28 and 30. The intake and exhaust ports 24 and 26 are provided in selective communication with the combustion chamber 22 to provide for the introduction of air or an air-fuel mixture into the combustion chamber 22 and the exhaust of products of combustion from the combustion chamber 22, respectively.

The piston 20 has a first skirt portion 32 and a generally opposed second skirt portion 34 depending or extending from the crown portion 18. An annular ring belt portion 36 extends peripherally between the crown portion 18 and the first and second skirt portions 32 and 34. A pin boss portion 38 extends from the crown portion 18 and is provided between the first and second skirt portions 32 and 34. The ring belt portion 36, shown in FIG. 1, is provided with a plurality of circumferential, axially spaced piston ring grooves which, in the present instance, consist of a first ring groove 40 extending closest to the crown portion 18, a second ring groove 42 spaced from the first ring groove 40 in a direction away from the crown portion 18, and a third ring groove 44 spaced from the second ring groove 42 in a direction further away from the crown portion 18.

The first ring groove 40 is provided with a first compression ring 46, while the second ring groove 42 is provided with a second compression ring 48. Additionally, the third ring groove 44 is provided with an oil control ring 50. The first and second compression rings, 46 and 48, have a dual purpose to seal the combustion chamber 22 against the passage of pressurized gases therein to a crankcase 52 and to limit the passage of lubricating oil, indicated by arrows 64 in FIG. 1, into the combustion chamber 22.

The piston 20 is arranged for slidable reciprocal motion within the cylinder bore 13. The first and second piston skirt portions 32 and 34 are engageable to guide the piston 20 in its reciprocating motion and to absorb thrust forces that may be imposed upon the piston 20 by the cylinder bore wall 14. The crown portion 18, as mentioned above, forms one wall of the combustion chamber 22 that, upon movement of the piston 20, causes the expansion or contraction of the combustion chamber 22 as is required for operation in an internal combustion engine working cycle.

To utilize the piston 20 as a means for developing power, the piston 20 is provided with a piston pin bore 54, defined by a generally circumferential pin bore surface 55 and extending axially through the pin boss portion 38. The piston pin bore 54 is dimensioned to receive a piston pin 56. The piston pin 56 connects the piston 20, through a connecting rod 58, with an eccentric throw 60 of a crankshaft 62. As such, the reciprocation of the piston 20 within the cylinder bore 13 causes the rotation of the crankshaft 62. The direction of rotation of the crankshaft 62 is indicated by arrow 63 of FIG. 1. The angular position of the connecting rod 58 with respect to the bore 13 varies as the crankshaft 62 rotates so that forces acting on the piston 20 in an axial direction are resolved partially into a side thrust component which alternately acts in opposite directions transversely on the piston 20 causing thrust forces between the first and second piston skirt portions 32 and 34 and the cylinder bore wall 14. Since a large part of the piston forces are due to gas pressures within the combustion chamber 22, the thrust forces acting on the piston 20 vary with these gas pressures. Therefore, the largest thrust forces act on one side of the piston 20, termed the major thrust side 67, which are caused by combustion gas pressures. The opposite side of the piston 20, termed the minor thrust side 69, has lower thrust forces caused largely by compression pressures within the combustion chamber 22, which are lower in magnitude than the combustion gas pressures.

In a four-stroke internal combustion engine, the crankshaft must make two full rotations, i.e. 720 degrees, for each combustion cycle. The first 180 degree rotation is the expansion or power stroke. During the power stoke, the rapidly expanding combustion gases exert force on the piston forcing it from a top dead center (TDC) position or the top of the stroke to a bottom dead center (BDC) position or the bottom of the stroke. It is during the power stroke that the chemical energy of the fuel-air charge mixture is converted to mechanical energy. The rotation from 180 to 360 degrees is the exhaust stroke. During the exhaust stroke, the piston moves from the BDC position to the TDC position forcing the burnt gases or products of combustion from the cylinder. The rotation from 360 to 540 degrees is the intake stroke wherein the air-fuel mixture is introduced into the cylinder as the piston moves from the TDC position to the BDC position. The rotation from 540 to 720 degrees is the compression stroke. During the compression stroke, the air-fuel mixture is compressed as the piston moves from the BDC position to the TDC position, after which time the cycle will repeat. Those skilled in the art of engine design will recognize that the crankshaft must make only one full rotation, i.e. 360 degrees, for each combustion cycle of a two-stroke internal combustion engine.

During operation of the internal combustion engine 10, the oil 64 is directed to interface between the cylinder bore wall 14 and the first and second skirt portions 32 and 34 to promote lubrication and heat transfer therebetween. The oil 64 may be provided by the splash oiling, oil exhausted from bearings, and/or alternate methods such as oil squirter nozzles.

Figure 2:
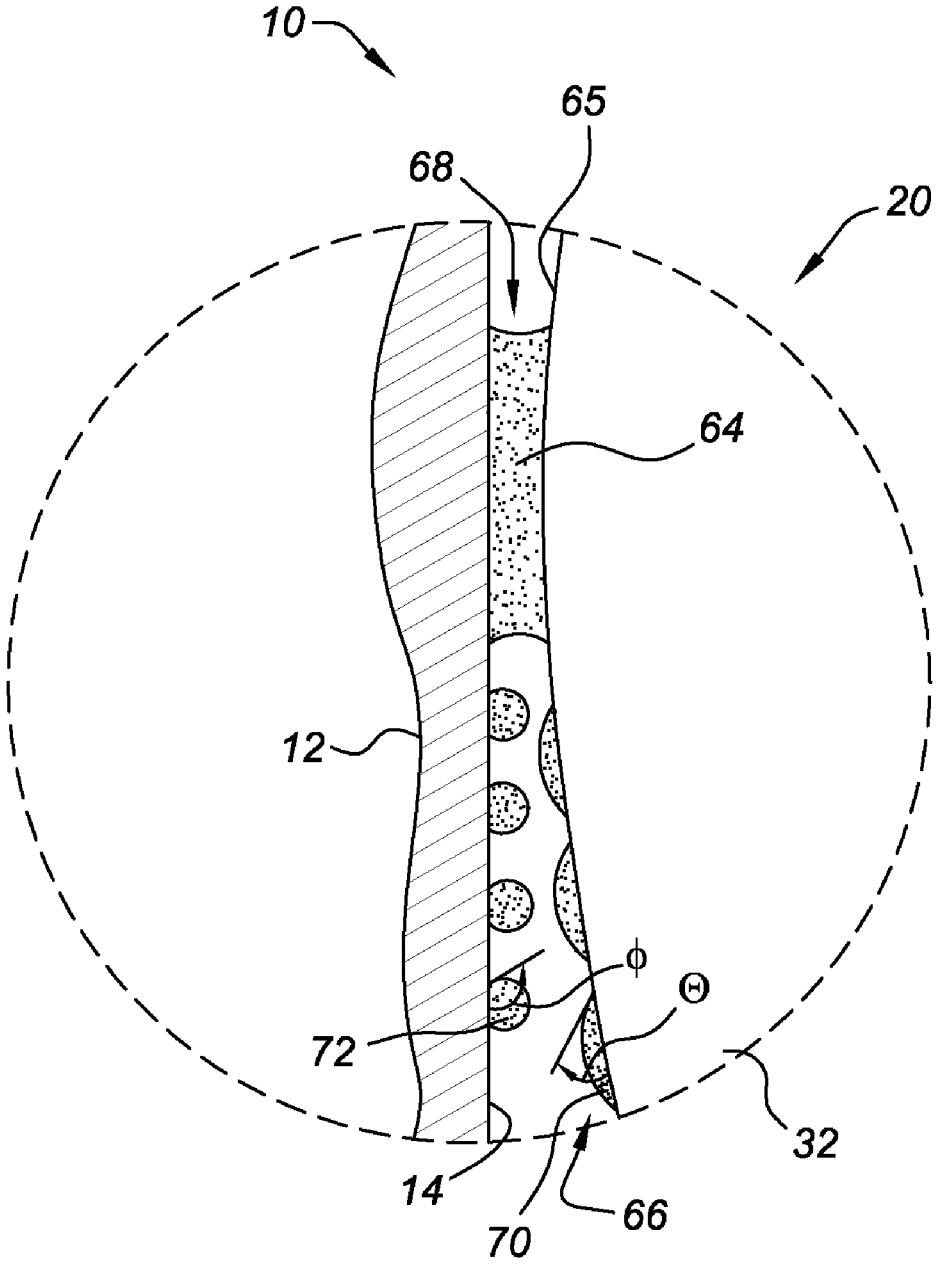
FIG. 2 is a magnified or enlarged transverse sectional fragmentary view of a portion, delineated by broken circle 2, of the internal combustion engine of FIG. 1 illustrating oil droplet geometries for a skirt portion of the piston and a cylinder bore wall defining a cylinder bore of the internal combustion engine.

Referring now to FIG. 2 and with continued reference to FIG. 1, there is shown a magnified fragmentary sectional side view of a portion, delineated by broken circle 2 in FIG. 1, of the internal combustion engine 10. Although only the first skirt portion 32 is shown in FIG. 2, those skilled in the art will recognize that similar structure and properties outlined below are equally applicable to the second skirt portion 34. The surface 65 of the first skirt portion 32 of the piston 20 is shown illustrating a generally barrel-shaped contour or profile 66; that is, the surface 65 of the first skirt portion 32 converges toward the cylinder bore wall 14 as it extends from the ring belt 36, shown in FIG. 1, to a point centrally located on the first skirt portion 32 and then diverges from the cylinder bore wall 14 such that a generally convex shape is achieved. It should be understood that the second skirt portion 34 has a similar barrel-shaped profile to that of the first skirt portion 32. A film 68 of oil 64 forms at a point where the first skirt portion 32 and the cylinder bore wall 14 are in close proximity and is operable to reduce friction between the first and second skirt portions 32 and 34 and the cylinder bore wall 14.

The internal combustion engine 10 is characterized as the first and second skirt portions 32 and 34 having greater wetability by the oil 64 than that of the cylinder bore wall 14. In other words, the contact angle θ of oil droplets 70 formed on the first skirt portion 32 is less than the contact angle Φ of oil droplets 72 formed on the cylinder bore wall 14 of the cylinder case 12. Preferably, the surface 65 of the first skirt portion 32 is formed such that it can be characterized as oleophilic or super-oleophilic, whereas the cylinder bore wall 14 is formed such that it can be characterized as oleophobic or super-oleophobic. Those skilled in the art will recognize that oleophilic refers to the property of having a strong affinity for oil, while oleophobic refers to the property of having a reduced or no affinity for oils. The contact angles θ and Φ may be determined by Young's equation:

$$\Theta, \Phi = \cos^{-1}\left(\frac{\gamma_{SV} - \gamma_{SL}}{\gamma_{LV}}\right)$$

where $\gamma_{SV}$ is the solid-vapor interfacial energy, $\gamma_{SL}$ is the solid-liquid interfacial energy, and $\gamma_{LV}$ is the liquid-vapor interfacial energy (i.e. surface tension). The oleophilic properties of the first skirt portion 32 and the oleophobic properties of the cylinder bore wall 14 may be provided by a surface treatment, such as a surface coating and/or machining strategy that will create texture at the micro- and nano-meter scale to alter the oil wetability and attachability characteristics of the cylinder bore wall 14 and the first and second skirt portions 32 and 34. An exemplary oleophilic surface coating is a nickel/silicon carbide matrix or zinc oxide, while an exemplary oleophobic surface coating may be formed from a flouropolymer such as polytetrafluoroethylene, or PTFE.

During operation of the internal combustion engine 10, the oil droplets 72 formed on the cylinder bore wall 14 of the cylinder case 12 are unstable as a result of the high contact angle Φ causing the oil droplets 72 to either drop from the cylinder bore wall 14 or contact the first skirt portion 32 and attach thereto. In so doing, the oil 64 is provided to lubricate the piston 20 as it translates within the cylinder bore 13, while reducing the amount of oil 64 that wets the cylinder bore wall 14 of the cylinder case 12. By reducing the wetting of the cylinder bore wall 14, the amount of oil 64 that is allowed to traverse the oil control ring 50 and the second and first compression rings 48 and 46 is reduced. This, in turn, reduces the hydrocarbon emissions as a result of the burning of oil 64 within the combustion chamber 22 of the internal combustion engine 10, while maintaining an adequate amount of oil 64 to maintain the film 68 during the up-stroke (i.e. the movement of the piston 20 between the BDC position and the TDC position) to ensure adequate lubrication near TDC thereby reducing losses as a result of friction and noise as a result of contact between the first piston skirt 32 and the cylinder bore wall 14.

While the best modes for carrying out the invention have been described in detail, those familiar with the art to which this invention relates will recognize various alternative designs and embodiments for practicing the invention within the scope of the appended claims.

The invention claimed is:

1. An internal combustion engine comprising:

a cylinder case having at least one cylinder bore wall defining at least one cylinder bore;

at least one piston reciprocally movable within said at least one cylinder bore;

wherein said at least one piston includes at least one skirt portion;

wherein said cylinder bore wall has an oleophobic characteristic; and wherein said at least one skirt portion has an oleophilic characteristic.

2. The internal combustion engine of claim 1, wherein said oleophobic characteristic is produced by at least one of coating and machining said at least one cylinder bore wall.

3. The internal combustion engine of claim 1, wherein said oleophilic characteristic is produced by at least one of coating and machining said at least one skirt portion.

4. The internal combustion engine of claim 1, wherein said at least one skirt portion is generally barrel shaped.

5. The internal combustion engine of claim 2, wherein said oleophobic characteristic of said at least one cylinder bore wall is formed from a flouropolymer coating.

6. The internal combustion engine of claim 3, wherein said oleophilic characteristic of said at least one piston skirt is formed from one of a coating of nickel/silicon carbide matrix and zinc oxide.

* * * * *